US005568586A

United States Patent [19]

Junkel

[11] Patent Number: 5,568,586

[45] Date of Patent: Oct. 22, 1996

[54] OVER-HEAT PROTECTION FOR A PORTABLE SPACE HEATER WITH THERMALLY INSULATED THERMOSTAT MOUNTED ABOVE SLOT CUT IN REFLECTOR

[76] Inventor: Eric F. Junkel, 2001 S. Webster La., Des Plaines, Ill. 60018

[21] Appl. No.: 492,424

[22] Filed: Jun. 19, 1995

[51] Int. Cl.[6] ..... H05B 3/00

[52] U.S. Cl. ..... 392/376

[58] Field of Search ..... 392/360, 361, 392/363–370, 373, 375–385; 219/508

[56] References Cited

U.S. PATENT DOCUMENTS

| | | | |
|---|---|---|---|
| 2,707,745 | 5/1955 | Farr et al. | 392/376 |
| 2,988,626 | 6/1961 | Buttner | 392/376 |
| 5,381,509 | 1/1995 | Mills | 392/376 |

FOREIGN PATENT DOCUMENTS

| | | | |
|---|---|---|---|
| 2364412 | 4/1978 | France | 392/373 |
| 332329 | 1/1921 | Germany | 219/508 |
| 7-139744 | 5/1995 | Japan . | |
| 963919 | 7/1964 | United Kingdom | 392/376 |
| 716678 | 8/1965 | United Kingdom | 392/368 |
| 791254 | 7/1968 | United Kingdom | 392/360 |
| 2183978 | 6/1987 | United Kingdom | 392/373 |

OTHER PUBLICATIONS

Antonetti, V. W. et al, "Heater Thermoswitch Protection", IBM Tech. Disclosure, vol. 11, No. 10, Mar. 1969.

*Primary Examiner*—John A. Jeffery
*Attorney, Agent, or Firm*—Howard R. Popper

[57] ABSTRACT

Over heat protection for a portable space heater equipped with a reflector for directing the radiation from a heating element through a frontal emitting window of the heater enclosure is provided by a conventional thermostat which is thermally insulated from the thermal mass of the heater enclosure and which is mounted so as to sense the temperature of convective air drafted up from in front of the window. The thermostat is mounted above a slot cut in the upper front edge of the reflector out of the path of the radiation directed by the reflector.

13 Claims, 3 Drawing Sheets

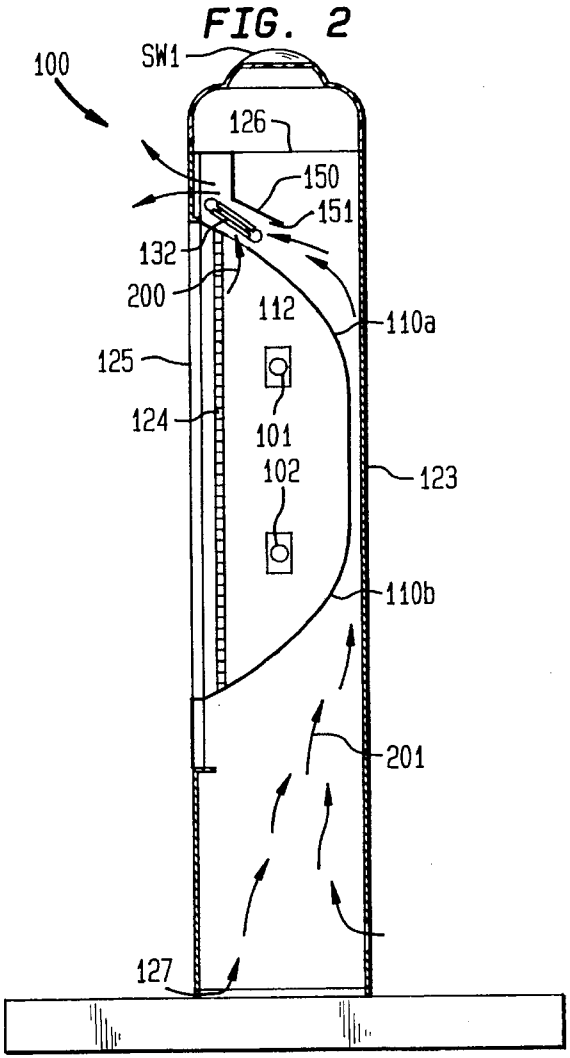
FIG. 2
100
SW1
126
150
151
132
200
125
124
112
101
102
110a
123
110b
201
127
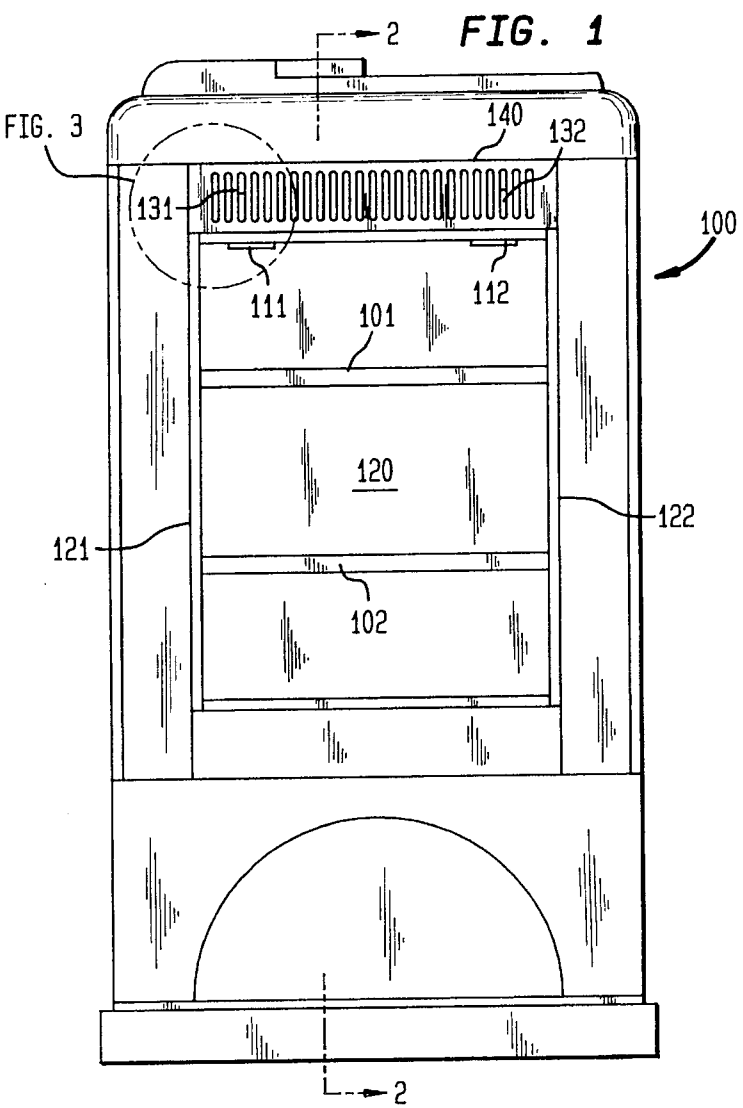
FIG. 1
100
2
140
132
112
101
111
131
FIG. 3
120
102
122
121
2

OVER-HEAT PROTECTION FOR A PORTABLE SPACE HEATER WITH THERMALLY INSULATED THERMOSTAT MOUNTED ABOVE SLOT CUT IN REFLECTOR

FIELD OF THE INVENTION

This invention relates to radiant heaters and, more particularly, to portable space or room heaters employing high intensity radiant heating elements.

BACKGROUND OF THE INVENTION

A radiant heater is a heater that is designed to transmit much of its heat energy by line of sight radiation rather than by convection. A typical radiant heater may use an open-wire, quartz jacket or flat panel heating element that is much hotter than the ambient temperature of the room. Recently, quartz jacketed heater elements containing a halogen gas and which emit more of their energy in the visible wavelengths have begun to replace conventional open-wire heating elements which emit more of their energy as infrared. The use of heater elements radiating their energy from a compact volume makes possible a more effective focusing of the radiant energy and, accordingly, radiant heaters using halogen heater elements tend to employ parabolic reflectors to focus their heat energy into a beam. The use of focused heating has allowed radiant heaters to operate at lower power levels while maintaining a comfortable level of heating.

While the use of a reflector materially improves the efficiency of heating the objects or persons in the beam path directly in front of the heater, it is necessary to reduce the likelihood that the intense heat radiated could cause a flammable object positioned too close to the front of the heater to overheat or burst into flame. Among the well-known overheat protection tests are the Canadian Standards Association (CSA) test in which a cheese cloth is used as the flammable object and the Underwriter's Laboratories standard UL 1278 which uses terry cloth towel material draped over different portions of the front of the heater. The use of terry cloth is a more severe overheat protection test than the use of cheese cloth because terry cloth offers more exposed fiber ends, is less permeable and subjects a greater effective area of flammable material to the heat source than does open-weave cheese cloth. Since terry cloth chars at about 200° C., a safety device must cut off electrical power before any local area of the terry cloth attains this temperature.

Since it is obviously impractical for a thermostat to directly sense the surface temperature of a flammable object that might be placed in front of the heater, indirect sensing is required. Portable radiant heaters employing halogen elements pose a particular difficulty in passing the draped terry cloth overheat protection test because they emit so concentrated a beam of light that a small spot on the terry cloth may receive sufficient radiant energy to catch fire. Conventional thermostats have not been effective in detecting the type of local hot spot produced during the drape test because, among other reasons, they are incapable of directly sensing temperature over the entire frontal area of the heater.

Heretofore, the only thermostatic technique which has allowed a high-intensity radiant heater to pass the terry cloth overheat protection test has required the use of a capillary tube thermostat as shown in U.S. Pat. No. 5,381,509 issued Jan. 10, 1995 and assigned to the W.B. Marvin Mfg. Co. The aforementioned patent teaches that a capillary thermostat should have its sensing tube positioned to extend across the front grille of the heater so that it will sense the temperature of the air heated by the surface of the object upon which the radiation from the heater is directed. While the capillary tube thermostat is effective as a overheat protection device, it is an expensive component compared to the cost of the other heater components.

PROBLEMS IN THE PRIOR ART

While many radiant heaters employ thermostats to permit the user to select a comfortable amount of heating, the use of a thermostat as an overheat protection device involves different considerations. Different heat settings are often selected by switching on one or more heating elements of the same power rating. When two power levels are permitted the high power setting will usually connect two heating elements to the current source while the low power setting will connect only one element. When three power levels are permitted, three elements are selectively connected. Typically, the various heating elements of a heater with multiple power settings are configured electrically in parallel so that at full power they all see the same voltage. To implement a lower power, one or more of the elements are disconnected from the circuit, the elements which remain connected emitting the same power as they did before, since they are connected to the same voltage. For a heater comprised of 2 heating elements of equal power rating, the low-power setting is 50% of full power.

An over heat protection thermostat should be set to interrupt power when an abnormal temperature is sensed. An abnormal temperature may be defined as the temperature rise produced by the least severe abnormal condition that causes the temperature to rise a given amount, e.g., 10° C. above the "normal" operating temperature. The abnormal temperature would be the temperature at which the thermostat should be set to respond. Thus, if a heater with multiple power settings is being operated at its full-power setting, the normal operating temperature of the area monitored by the thermostat may, illustratively, safely be allowed to reach a temperature of 100° C.. When the heater is being operated at a lower power setting, the normal temperature at the aforementioned point may reach only 90° C. When a temperature that is 10° C. higher than normal is sensed (as the result of an abnormal condition), the thermostat should cause power to be interrupted. At the high-power setting this would be 110° C. but only 100° C. at the low-power setting. Since a conventional thermostat can sense only a single temperature this means that the region monitored by the thermostat could rise by 20° C. at the low-power setting before power would be cut off. However, if so set, the thermostat would not sense the least severe abnormal condition at low power. Because the low-power setting is often implemented by turning on one element at its full power, this may be sufficient to create a hot spot on the terry cloth but the hot spot would not be sensed by the thermostat. On the other hand, if the thermostat were set low enough to trip for an abnormal condition at the lower power level, the thermostat might improperly cut off power—a "nuisance trip"—at the higher power setting. The problem is made even more difficult if the heater is to be operated safely over a range of ambient temperatures, as in the case of a heater with continuously variable power settings.

Heretofore the low-power overheat protection problem has been avoided either by restricting the heater to one power setting or, if two power settings are allowed, they are not allowed to be very different. Typical are radiant heaters with selectable power settings of 1200 W and 1500 W.

Accordingly, the need exists to satisfy the conflicting goals of finding a way to have a bright, variable power, focused radiant heater which employs an economical form of safety shutoff that is sufficiently sensitive to abnormal conditions and yet is sufficiently insensitive to changes in ambient temperature or heater front panel settings so as not to cause nuisance shut-offs. Stated differently, there is a need to solve the overheat protection problem at different power settings (especially, the low-power setting), without the use of a capillary tube thermostat.

SUMMARY OF THE INVENTION

We have discovered how conventional thermostats may be employed as overheat protection devices for use with high-intensity radiant heaters. The conventional thermostat when used as an overheat protection device must be employed to be thermally responsive in a different fashion than when used merely to regulate the temperature for a comfortable level of heating. When used to monitor temperature to establish a comfortable heating level the thermostat may properly be positioned to measure the enclosure temperature, especially when the enclosure is vented by a fan. However, when used as an overheat protection device, the thermostat must be immediately sensitive to the temperature of the heated air across the front of the heater. For example, it is common practice, as shown for example, in Farr et al U.S. Pat. No. 2,707,745 or Krichton U.S. Pat. No. 3,051,820, to mount a thermostat in the air chamber of the heater to sense the ambient air temperature before the air is heated; or to mount a thermostat in the air chamber below and behind the reflector, as in Markel U.S. Pat. No. 2,852,657. However, even if the thermostats in these prior art systems were empirically adjusted to trip when the temperature at the front of the heater were less than 200° C., the thermal capacitances of the heater enclosure and air spaces could keep the thermostat from sensing the temperature rise fast enough to open the electrical circuits before damage occurred. Thermostat response when used as an overheat protection device must be both timely and accurate.

For example, when directly mounted on the enclosure, on the reflector or in the air space behind the reflector, the thermostat's response to an abnormal condition is delayed until the enclosure, reflector and/or air spaces are heated. As the enclosure often has far greater thermal capacitance than the heated air in front of the enclosure, it takes a long time for the enclosure to be heated by the air and then to heat the thermostat. The most difficult test condition for a reflector-equipped heater that focusses the light is actually at moderate distances where there may not be enough heat in the convected air near to the enclosure to trigger a thermostat.

Accordingly, when draped with terry cloth or when an obstruction is placed in front of the heater, the radiant energy is absorbed by the draping or obstructing material which then heats up, delivering some of their heat to the surrounding air. As the air heats, it rises and sets up a convection cell with the warmed air rising from below the heater to above it. If the entire heater is covered, the convection air current will not move very quickly but the trapped air will be hotter. If only a portion of the front of the heater is draped with the terry cloth, the convected air current will be cooler and move faster. If the flammable material is moved far away little heating of its surface occurs and there is little convection in the proximity of the heater but there is also little risk of charring at that point.

FEATURES OF THE ILLUSTRATIVE EMBODIMENT

I have discovered that the overheat protection problem associated with the use of high-intensity radiant heaters, particularly at low-power settings, may be solved without resort to the use of a capillary tube thermostat by appropriately locating conventional thermostats and taking certain other measures. In accordance with the principles of my invention, in one illustrative embodiment thereof, I provide conventional overheat protection thermostats which are located in pairs, at the front of the enclosure, thermally insulated from the thermal mass of the enclosure housing and positioned to sense the convective air directly heated by the heating elements as well as the convective air drafted up from in front of the heater but out of the direct line of sight of the heating elements. More particularly, the thermostats are located behind openings in the top edge of the heating element reflector to permit sensing of convected air currents drafted up by a heated surface in front of the heater.

DESCRIPTION OF THE DRAWING

FIGS. 1 and 2 are front and side cross-sectional views of an illustrative embodiment of a portable space heater having high intensity radiant heating elements, such as quartz halogen heating tubes;

Referring now to FIGS. 1 and 2, there are shown the front and side views of a portable room heater 100 having a housing enclosure 120 defined by left and right side walls 121, 122, back wall 123, front window 125 and top and bottom 126, 127. Radiant energy heating elements 101, 102, such as quartz halogen heating tubes, are suitably mounted in front window opening 125 between side walls 121, 122. A reflector 110, extending between side walls 121, 122, is mounted behind the heating tubes to direct the radiant energy out through the front of window opening 125. Although heating tubes are advantageously positioned at the respective foci of parabolic sections 110*a*, 110*b* of reflector 110, the region between section 110*a* and 110*b* is advantageously more flattened then would be the region between purely parabolic sections behind heating elements 101, 102. The purpose of the flattening is to diffuse or slightly defocus the radiant energy emitted from the front window opening 125 so that the heat contributed by the combined radiation from elements 101, 102 will not sharply peak or create a ultra-hot heat line in front of the heater. Advantageously, a honeycomb grille 124 is mounted in window 125 to protect tubes 101, 102 and to assist in channelling the radiant heat from tubes 101, 102 through window opening 125. In addition, an open wire grille, not shown, is preferably mounted in front of honeycomb grille 124 further to protect the heating tubes and to exclude foreign objects from enclosure 120. Electrical controls, such as switch SW1 (whose connection is shown in FIG. 4), may advantageously be mounted at the top of enclosure 120.

Figure 3A:
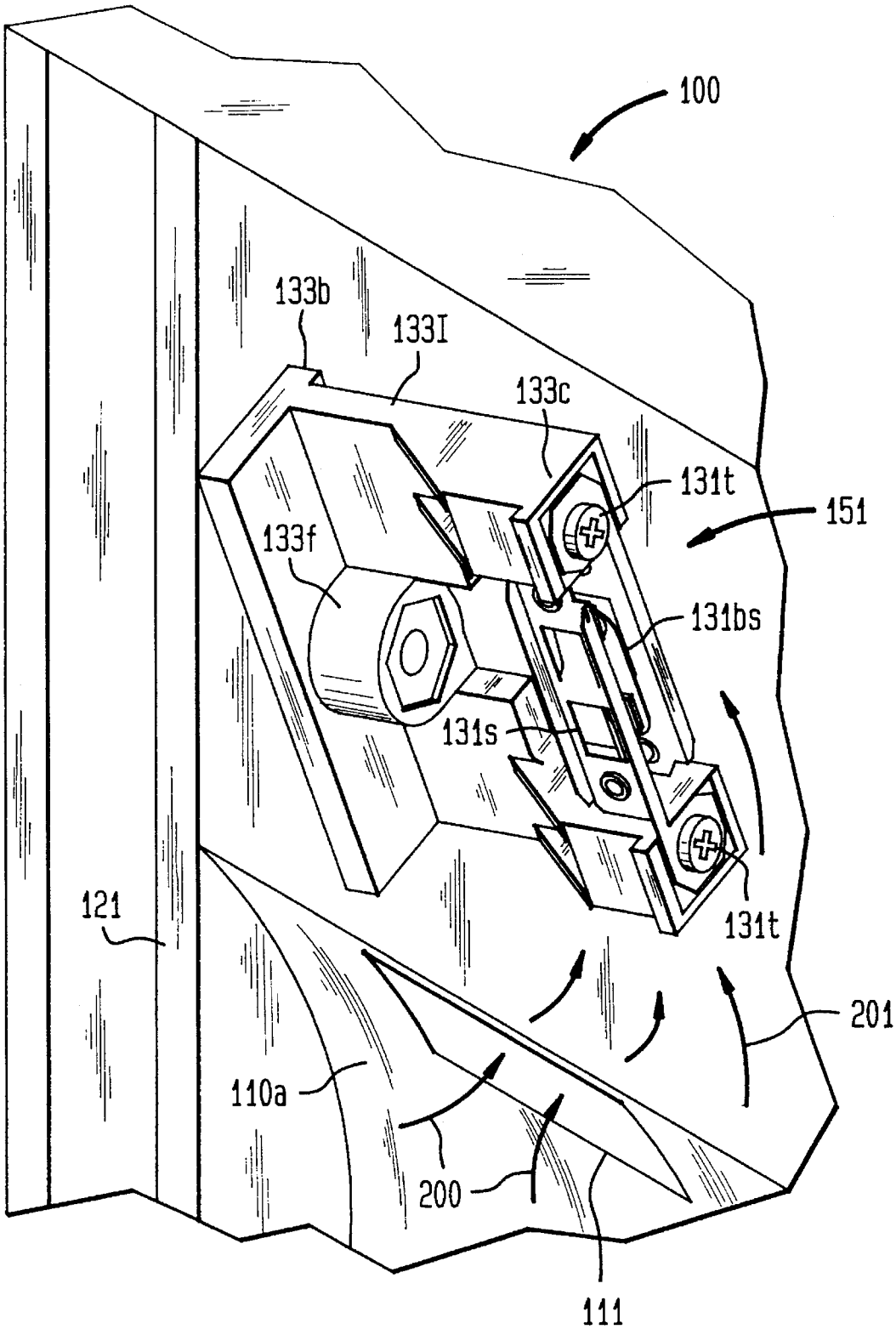
FIGS. 3A and 3*b* are enlarged views showing details of the mounting of the overheat protection thermostats in the illustrative embodiment of my invention.
Figure 3B:
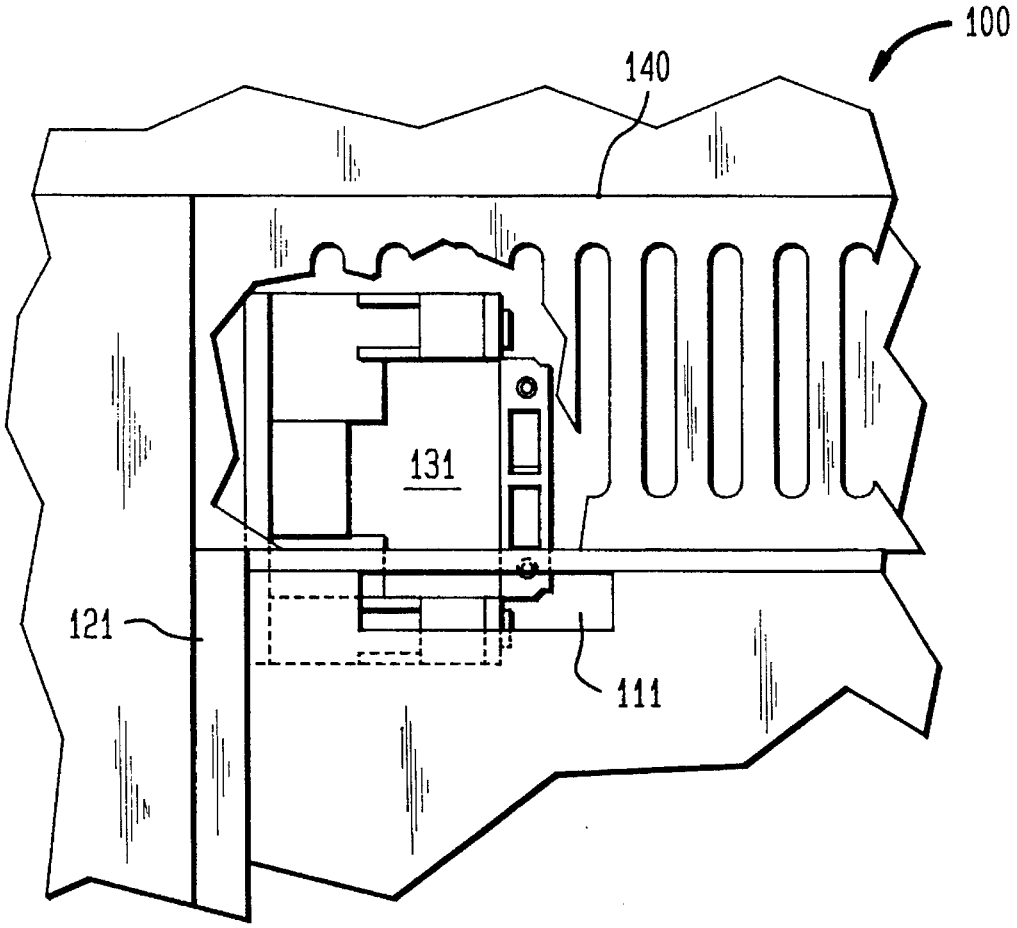

Upper-most reflector 110*a* is provided with a pair of longitudinally spaced-apart rectangular slots 111, 112 having their long dimension parallel to the axes of tubes 101, 102. Slots 11, 112 are oriented out of the path of the direct, radiant energy focused by reflector 110. Mounted within enclosure 120 above the slots 111, 112 and behind reflector 110*a* are manual reset thermostats 131, 132. Thermostats 131, 132 are mounted on individual thermal insulators 133, 134 which, advantageously, may be made of polymeric material and which may include a mineral filler. A frontal plenum chamber 151 is defined within housing 120 by the back of reflector 110*a*, the side walls 121, 122 and baffle plate 150. Plenum 151 channels both the heated convective air 200 rising from radiant heating elements 101, 102 as well as the convective air 201 drafted up from in front of window 125 and which enters the bottom 127 of enclosure 120 and rises behind reflectors 110*a*, 110*b* to pass through the thermostats 131, 132. The convective air passing thermostats 131, 132 is vented outside the housing 120 through multiply slotted vent panel 140.

It should be noted that when an obstruction, such as the terry cloth used in the above-mentioned UL test, is placed in front of heater window 120 the temperature of convective air 200 passing through slots 111, 112 and drafted up from in front of window 120 will rise much sooner and its temperature will rise faster than that of convective air 201 entering the enclosure and passing behind reflector 110.

Referring now to FIGS. 3A there are shown enlarged views of the frontal plenum 151 within enclosure 120 in which thermostat 131 is located. Thermostat 131 is mounted above slot 111 behind reflector 110*a* and angled (see FIG. 3A), so as to maximize its exposure to the convective air 200 heated by the radiant heating tubes (FIG. 1), as well as the convective air 201 rising behind reflector 110*a*.

Thermostat 131 is mounted on thermal insulator 133 and comprises an assembly which includes a temperature sensing element 131*bs* and electrical terminals 131*t* leading to and from the temperature sensing element 131*bs*. To enhance the sensitivity of the operation of temperature sensing element 131*bs*, thermostat 131 has louvre-slots 131*s* through which air may pass without being entrapped.

Thermal insulator 133 itself comprises four distinct portions. At one end are base portion 133*b* and fastener portion 133*f* which provide for securing the thermostat assembly to enclosure 120, such as by a sheet metal screw, to side wall 121. At the other of its ends, insulator 133 accommodates the terminal portions 131*t* of thermostat 131. Intermediate its two ends, thermal insulator 133 is provided with a thermal isolator section 133I which advantageously has a reduced cross-sectional area to increase its thermal resistance.

Figure 4:
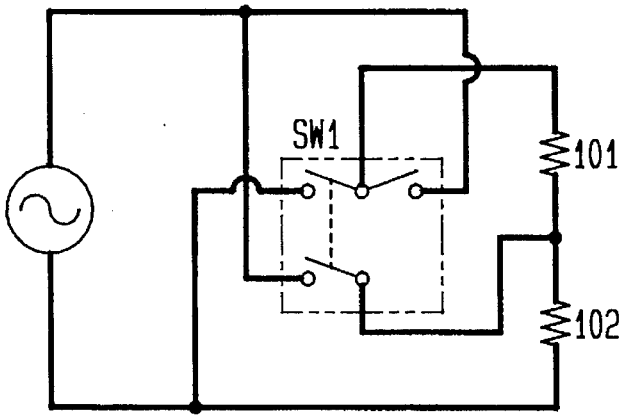
FIG. 4 is a schematic diagram showing the manner of achieving high and low heat settings for the radiant heaters.

Referring to FIG. 4, there is a schematic diagram for connecting the heating tubes 101, 102 either in parallel, when switch SW1 has its left arms closed and its right arm open, or in series, when switch SW1 has its left arms open and its right arm closed. Assuming that heating elements 101, 102 are of equal power, a lower power level is obtained by putting the two elements in series while a higher power level is obtained when the elements are connected in parallel. While at first glance, one might think the power level would be ¼ that of the same two elements in parallel, it must be recognized that the resistance of the wire changes with power levels so the power level can rise to about ⅓ of full power.

In addition to appropriately locating the over heat protection thermostats, it is important to properly establish their set point. The temperature setpoint (Ts) should be established at less than the normal operating temperature reached when the ambient temperature is 25° C. ($Ta_{nom}$) plus the smallest temperature rise under all abnormal conditions ($Tc_{min}$) [$Ts<Ta_{nom}+Tc_{min}$] and Ts is greater than the sum of the normal operating temperature at maximum ambient temperature ($Ta_{max}$) plus the temperature margin required to avoid nuisance trips (Tm) [$Ts>Ta_{max}+Tm$].

What has been described is deemed to be descriptive of my illustrative embodiment. Numerous modifications may be made by those skilled in the art without, however, departing from the spirit and scope of my invention. For example, the thermal insulation of the thermostats from the thermal mass of the rest of the heater enclosure may be increased by insulating the back of the reflector behind the high-power heating element. The thermal resistance between the enclosure and the thermostats may be increased and the thermal resistance between convected air and the thermostat may be decreased by the use of a heat sink with fins. Mounting the thermostat to a heat sink that itself is mounted on thermal insulator posts with insulating fasteners is one method. Radiation from the heating elements should be blocked from hitting the heat sink directly, as in FIG. 1.

What is claimed is:

1. A portable space heater, comprising:

a housing having at least one anterior heat-discharging opening;

heating element means for providing a source of radiant heating energy;

reflector means for directing the radiant energy emitted by said element principally toward the front of said heat-discharging opening, a slot provided in the uppermost portion of said reflector for permitting convective air from in front of said heat-discharging opening to rise therethrough;

thermostat means; said thermostat means being positioned behind said reflector means and above said slot to sense said convective air and being connected to interrupt the radiant energy emitted by said heating element when a predetermined temperature is reached in front of said housing;

thermal insulator means for thermally insulating said thermostat means from the thermal mass of said housing.

2. A portable space heater according to claim 1 wherein said reflector means includes two segments having substantially parabolically shaped cross-sections, wherein said source of radiant energy comprises a pair of halogen quartz heating tubes positioned substantially at the focus of said segments, said segments being shaped to substantially diffuse the peaks of the focused radiant energy away from the center of said opening.

3. A portable radiant heater comprising:

an enclosure housing radiant heating element means and a reflector for directing radiant energy from said element through the front of said enclosure;

thermostat means for sensing the temperature of the convective air drafted up principally from in front of said heater and for interrupting the radiant energy emitted by said heating element when a predetermined temperature is reached in front of said enclosure; and means for thermally insulating said thermostat from the thermal mass of said enclosure, said insulating means including a thermal insulator block, said thermostat being mounted on said thermal insulator block above and behind said reflector.

4. A portable radiant heater according to claim 3 wherein said radiant heating element means includes a pair of heating elements and switch means for selectively connecting said heating elements in parallel for a high power setting and in series for a low power setting.

5. A portable radiant heater comprising:

an enclosure housing radiant heating element means and a reflector for directing radiant energy from said element through the front of said enclosure, said reflector including a slot at the front of its upper edge;

thermostat means for sensing the temperature of the convective air drafted up principally from in front of said heater and for interrupting the radiant energy emitted by said heating element when a predetermined temperature is reached in front of said enclosure; and means for thermally insulating said thermostat from the thermal mass of said enclosure, said insulating means including a thermal insulator block, said thermostat being mounted on said thermal insulator block above said slot and behind said reflector and out of the path of the radiant energy directed by said reflector.

6. A portable radiant heater according to claim 5 wherein said reflector includes a plurality of longitudinally spaced-apart elongated slots having their long dimension parallel to the axis of said radiant heating element and wherein said thermostat is mounted above said slots behind said reflector and out of the path of the radiant energy directed by said reflector.

7. A portable radiant heater according to claim 6 wherein said reflector includes parabolically shaped first and second sectors and wherein said radiant heating element means comprises a respective radiant element positioned at the focus of each of said parabolically shaped sectors.

8. A portable radiant heater according to claim 7 wherein said reflector is flattened between said parabolically shaped sectors to diffuse said radiant energy so that the heat contributed by the combined radiation from each said element will not be concentrated in a linear region in front of said heater.

9. A portable radiant heater according to claim 7 wherein said insulator block includes a first portion for mounting said block to said enclosure, a second portion for mounting said thermostat and a third thermal isolating portion intermediate said first and second portions.

10. A portable radiant heater according to claim 6 wherein said thermostat is oriented with its long dimension parallel to the direction of said convective air rising through said slot.

11. A portable radiant heater according to claim 6 wherein said thermostat is set to interrupt said radiant energy at a set point temperature (Ts) which is:

less than the normal operating temperature reached when the ambient temperature is 25° C. ($Ta_{nom}$) plus the smallest temperature rise under all abnormal conditions ($Tc_{min}$) [$Ts<Ta_{nom}+Tc_{min}$] and which is:

greater than the sum of the normal operating temperature at maximum ambient temperature ($Ta_{max}$) plus the temperature margin required to avoid nuisance trips (Tm) [$Ts>Ta_{max}+Tm$].

12. A portable radiant heater comprising:

an enclosure housing radiant heating element means and a reflector for directing radiant energy from said element through the front of said enclosure, said reflector having a plurality of longitudinally spaced-apart elongated slots having their long dimension parallel to the axis of said radiant heating element, said plurality of slots including a pair of slots at the front upper edge of said reflector;

a pair of thermostats respectively mounted above said pair of slots and behind said reflector and out of the path of the radiant energy directed by said reflector for sensing the temperature of the convective air drafted up principally from in front of said heater and for interrupting the radiant energy emitted by said heating element when a predetermined temperature is reached in front of said enclosure, and means for thermally insulating said thermostat from the thermal mass of said enclosure, said insulating means including a thermal insulator block, said thermostat being mounted on said thermal insulator block.

13. A portable radiant heater according to any of claims 3 through 12 wherein said radiant heating element means includes a quartz halogen heating tube.

* * * * *